US006257878B1

(12) United States Patent
Marr et al.

(10) Patent No.: US 6,257,878 B1
(45) Date of Patent: Jul. 10, 2001

(54) PREFORMED MODULAR TREFOIL AND INSTALLATION METHOD

(75) Inventors: Ronald J. Marr, Sykesville, MD (US); Larry E. Shultz, York, PA (US)

(73) Assignee: J. E. Baker Company, York, PA (US)

( * ) Notice: Subject to any disclaimer, the term of this patent is extended or adjusted under 35 U.S.C. 154(b) by 0 days.

(21) Appl. No.: 09/499,788

(22) Filed: Feb. 8, 2000

(51) Int. Cl.[7] ..... F27B 7/00
(52) U.S. Cl. ..... 432/103; 432/118; 432/119
(58) Field of Search ..... 432/103, 105, 432/108, 110, 111, 118, 119

(56) References Cited

U.S. PATENT DOCUMENTS

| | | | | |
|---|---|---|---|---|
| 1,431,530 | | 10/1922 | Leicester . | |
| 1,534,475 | | 4/1925 | Willett et al. . | |
| 1,741,680 | | 12/1929 | Davey . | |
| 2,341,971 | | 2/1944 | Antill | 72/102 |
| 2,889,143 | | 6/1959 | Reaney et al. | 263/33 |
| 3,030,091 | | 4/1962 | Wicken et al. | 263/32 |
| 3,036,822 | | 4/1962 | Andersen | 263/32 |
| 3,169,016 | | 2/1965 | Wicken et al. | 263/32 |
| 3,175,815 | | 3/1965 | Wicken et al. | 263/32 |
| 3,201,100 | | 8/1965 | Dussossoy | 263/33 |
| 3,221,614 | | 12/1965 | Pertien | 94/13 |
| 3,227,430 | * | 1/1966 | Vaughan, Jr. | 432/118 |
| 3,346,248 | | 10/1967 | Martinet et al. | 263/33 |
| 3,362,698 | | 1/1968 | Cerny et al. | 263/33 |
| 3,521,867 | * | 7/1970 | Bucchi | 432/118 |
| 3,834,108 | | 9/1974 | Ludvigsen | 52/593 |
| 4,340,360 | | 7/1982 | Hoedl et al. | 432/119 |
| 4,475,886 | | 10/1984 | Tyler | 432/118 |
| 4,543,893 | | 10/1985 | Künnecke | 110/338 |
| 4,846,677 | | 7/1989 | Crivelli et al. | 432/118 |
| 4,960,058 | | 10/1990 | Materna | 110/336 |
| 4,975,049 | | 12/1990 | Roenigk et al. | 432/118 |
| 5,330,351 | | 7/1994 | Ransom, Jr. et al. | 432/103 |

OTHER PUBLICATIONS

Lime, "Castable trefoils in rotary lime kilns", Pit & Quarry, 1984, 46, 47, 50.

* cited by examiner

*Primary Examiner*—Jiping Lu
(74) *Attorney, Agent, or Firm*—Woodcock Washburn Kurt Mackiewicz & Norris

(57) ABSTRACT

A trefoil for a rotary kiln is provided that has at least three spoke-like refractory legs. Each one of the legs extends radially outwardly from a center of the trefoil; spans approximately from the kiln shell to the center of the kiln; is pre-formed outside of the kiln for installation as a single-leg unit; and has a mating surface that preferably is uniform and even, thereby lacking interlocking features. The mating surfaces of the legs abut one another at the kiln center to provide mutual support. An alignment member, such as a pair of longitudinal angles, are welded to the kiln shell to position the legs. A corresponding method of installing the trefoil is disclosed that includes positioning and shimming the first two legs at the 4 o'clock position and 8 o'clock position, and installing the third leg at the 12 o'clock position.

4 Claims, 7 Drawing Sheets

PREFORMED MODULAR TREFOIL AND INSTALLATION METHOD

BACKGROUND

The present invention relates to internal structures of rotary kilns, and more particularly to trefoil structures in rotary kilns, and even more particularly to preformed, modular trefoils and installation methods for the same.

A rotary kiln is a long refractory-lined cylinder that thermally treats material as its flows from its upper, feed end to its lower, outlet end. The kiln is slightly inclined and rotates about its longitudinal axis to promote material flow. Most kiln processes are counter-current such that the hot gas flows from the material outlet end to the material inlet end. The kiln includes a steel shell having a refractory lining on its inside surface. For larger kilns, the refractory lining typically includes a refractory brick lining. Rotary kilns generally operate on a twenty four hour basis for several months between scheduled down periods.

Rotary kilns are employed for calcining limestone, calcining and sintering dolomite and magnesite, lime re-burning in paper plants, processing cement, calcining petroleum coke, various incineration processes, and similar thermal processes. In a lime manufacturing process, coarse limestone is fed into the feed end of the kiln. As the limestone feed tumbles down the kiln, it is dried and then calcined into lime by the hot gases.

Rotary kilns may employ internal heat exchanger structures, such as refractory trefoils or metallic heat exchanges that divide the cross section of the kiln into three or more segments to enhance the heat transfer from the gas to the material, improve mixing of the material, and provide similar benefits. Although trefoils enhance heat transfer from the gas to the material, conventional trefoils constrict the overall area through which the counter-current air stream may flow. Such a constriction is an undesirable design limitation of the trefoil because the constriction increases the pressure in the burning zone and the air velocity in the trefoil area, therefore affecting the flame burning characteristics and heat transfer, and may also increase the dust load carried by the air stream. The weight of current refractory trefoil designs is considerably more per foot if rotary kiln than a single layer brick lining, and thus exerts additional mechanical stress on the kiln shell.

Trefoils within a rotary kiln encounter harsh operating conditions. For example, internal gas temperatures may typically be 1000 to 3000 degrees F. in a highly basic atmosphere in a rotary lime kiln, although temperatures outside of this range are possible depending on the particular application. The trefoil must take the structural loading and erosion from several hundred tons per day of partially calcined rock that slides across or falls against the surfaces of the trefoil. The trefoil is continuously rotated with the kiln, which subjects the trefoil components to varying compressive and tension force. Further, the trefoil must withstand the kiln shell deflection upon revolution over its roller supports. The trefoil is critical to the operation of the manufacturing facility—often failure of a trefoil during operation requires the entire manufacturing facility to be shut down for repairs. Without the trefoil's improved heat exchange, product sintering may be inadequate. Many kilns also employ expensive metallic heat exchangers, which require refractory trefoil heat exchangers "down kiln" of them to avoid damage from high gas temperatures. Trefoils generally reduce fuel consumption and also government-regulated stack emissions. Failure of a trefoil may therefore cause a rotary kiln plant to become "non-compliant", leading to a shut-down or significant monetary penalties.

Conventional trefoils typically are from 9–15 feet long along the longitudinal kiln axis, depending on the kiln diameter and other parameters, and having "spokes" or legs typically from, 9–12" thick. A refractory trefoil often obtains the vast majority of its heat exchange benefits in about the first 3 inches of material thickness beneath the surfaces exposed to the heat. A trefoil "leg" is exposed to hot gasses and material on two faces during each revolution; thus trefoil thicknesses over about 6 inches are unnecessary for the heat exchange function. Conventional trefoils employ leg thicknesses from about 9–12 inches primarily to provide mechanical stability within the severe rotary kiln environment. These thicknesses have been found to be needed because of tendency of conventional bricks to shift from proper alignment and thus fail prematurely and from the inability to obtain satisfactory strength from "in-situ" cast and cured monolithic trefoils.

Conventional trefoils typically are formed from individual (usually interlocking) refractory bricks, although some were formed from "in-situ" cast and cured monolithics. The manufacturing process for producing bricks includes high pressure pressing, often at 15,000 to 20,000 pounds per square inch (PSI), and firing, often up to approximately 2,400 degrees F. (or higher). Bricks produced by pressing and firing typically have high density, low porosity, good volume stability upon heating, and high mechanical strength at standard and elevated temperatures. However, brick size and complexity of shape axe limited by the mechanical limitations of pressing and handling equipment.

Brick trefoils, therefore, generally employ small standard, interlocking shapes that require specially engineered and formed shapes to form contours at the shell and near the hub. The limitations of brick technology generally require leg thicknesses greater than about the 6 inches optimum for heat transfer. Installation is labor-intensivle and requires specially skilled artisans to form the trefoil. They also require complicated forms (specific to a single rotary kiln size) to support them during construction. Thus, brick trefoils are slow to install and are expensive.

Further, technical considerations of trefoil design include the kiln diameter, kiln ovality, expected kiln deflection, expansion or contraction characteristics of the brick upon heating, kiln internal temperature range, and type of product.

For example, a particular design concern is the choice of the number of joints that form the trefoil leg. The joints enable a small amount of flexing, for example upon kiln shell deflection during rotation, which increases the elasticity and diminishes excessive mechanical stress of the brick trefoil leg. However, the working of adjacent bricks, which may cause wear and failure, counter-balances the benefit of increased elasticity. Thus, an appropriate number and design of brick trefoil joints, which is mostly based on empirical knowledge, balances these factors U.S. Pat. No. 5,330,351, entitled "Trefoil Construction For Rotary Kilns" ("Ransom") discloses a trefoil which has legs that are each formed from four basic, precast shapes assembled in the kiln. Several blocks of some of the types of shapes are employed to form the trefoil. Conventional brick trefoils generally include shapes that interlock, including, for example, tongue-and-groove type interlocking pieces, as disclosed for example in the '351 patent (Ransom). The interlocking shapes prevent or limit relative movement of the bricks, which may subject the interlocking parts to shear forces. Because of the high strength required of the protruding portions, among other factors, the interlocking bricks or shapes employed in rotary kiln trefoils generally must have a high hot modulus of rupture (HMOR). For example, the '351 patent (Ransom) discloses ultra-high strength castable having a HMOR of 3000 PSI at 2500 degrees F.

Other examples of conventional trefoils include U.S. Pat. No. 3,030,091, entitled, "Rotary Kiln with Heat Exchanger" ("Witkin") which discloses a rotary kiln having a trefoil heat exchanger with each section having a dam at the downstream end. Further, U.S. Pat. No. 3,036,822, Entitled, "Rotary Kiln with Built-in Heat Exchanger" ("Anderson") discloses a rotary kiln with partitions dividing the material stream into six segments. U.S. Pat. Nos. 3,169,016 and 3,175,815, entitled "Kiln" ("Witken") disclose a trefoil having apertures that enables material to drop into an adjacent chamber to enhance heat transfer. U.S. Pat. No. 4,846,677, entitled, "Castable Buttress for Rotary Kiln Heat Exchanger and Method of Fabricating" ("Crivelli") discloses a trefoil rotary kiln with buttressed end portions of poured-in-place cast refractory to prevent the trefoil from sliding downhill during kiln rotation.

Within the past 30 years, in-situ cast monolithic refractory trefoils have been installed in commercial rotary kilns. However; because of premature wear, complicated forms, and slower installation than brick, "in-situ" casting quickly became typically commercially untenable. In-situ casting includes building forms within the kiln that are attached to the kiln shell. A first form having a height less than the kiln radius is erected at the bottom dead center of the kiln. After castable refractory is mixed with water and poured into the first form, and after a waiting period of from 18 to 36 hours is allowed for setting, the kiln is rotated by 120 degrees (for a three-leg trefoil) and the first form is supported by temporary bracing. Castable refractory is poured into a second form erected and braced like the first, and the kiln is rotated another 120 degrees for pouring castable refractory in a third form. A hub form is erected to join the innermost ends of the castable members, and castable refractory is poured within the hub form. Often after a day of air-drying, the forms are removed and the kiln is heated slowly according to a drying and curing schedule of the castable refractory.

FIG. 6 (Prior Art) shows a cross sectional view of a portion of a castable trefoil 110 during forming. Partially formed trefoil 110 has three forms 108A, 108B, and 108 C filled with castable refractory 112A, 112B, and 112C, respectively, with the hub form 109 ready to receive castable refractory. The cast structure is secured to the kiln shell 106 by v-shaped anchors, which are not shown. The rotary kiln brick 107 is shown schematically, and the brick 107 will abut the refractory 112A, 112*b,* and 112C to cover the interior surface of the kiln shell 106 after the forms 108A, 108B, and 108C are removed.

Although less expensive than brick trefoils, "in-situ" cast trefoils tend to have a shorter life than brick trefoils for three main reasons. First, the lack of joints create excessive mechanical stress from the rotation and deflection of the kiln shell, and from thermal factors. Second, castable refractory products generally do not match brick products in strength or thermal properties unless cast/cured under tightly controlled conditions. Third, because a rotary kiln can not be rotated at full speed in a cold state because of the risk of the brick lining being dislodged from the shell but must be rotated when hot (to prevent sagging of the steel shell); a very rapid heat-up schedule is typically used, which forces a castable trefoil to undergo a much shorter than optimum curing period.

Additional disadvantages of the cast in-situ method include: the need to handle, assemble, and disassemble bulky molds inside the rotary kiln; difficult curing of the refractory monolith during the burn-in of the rotary kiln; and difficulties working with wet materials in sub-freezing temperatures.

Regardless of how the trefoil is formed, trefoil installation and maintenance generally require the kiln, and thus the entire manufacturing facility, to be shut down for several days. For example, an operational rotary lime calcining kiln may require one or two days to cool the system from its operating temperature just to enable personnel access. The extensive time required for installing a brick trefoil or a forming a cast trefoil adds downtime and cost.

It is a goal of the present invention to provide a trefoil that is easy or cost effective to produce and install and that has good mechanical and structural properties, and to provide method of installing the trefoil.

SUMMARY OF THE INVENTION

A trefoil heat exchanger according to an aspect of the present invention is provided for use within a rotary kiln that includes a cylindrical steel shell with an internal refractory lining. The trefoil comprises at least three spoke-like refractory legs. Each one of the legs extends substantially radially outwardly from a center of the trefoil and includes a foot, a mating end opposing the foot, and a body extending between the fool and the mating end.

Each one of the feet adjoins the kiln shell. Each one of the mating ends adjoins adjacent ones of the mating ends substantially at a center of the trefoil. Each one of the legs is preformed outside of the kiln for installation as a single-leg unit such that the body of each one of the legs is continuous between the foot and the mating surface. Each one of the legs supports other ones of the legs as the kiln rotates and preferably has an overall length approximately equal to an internal radius of the kiln shell. Each of the legs is substantially uniformly circumferentially spaced apart from other ones of the feet.

According to another aspect of the present invention, a steel channel-like member is provided that is coupled to the kiln shell for receiving the foot therein. The channel like member may receive shims to enable alignment of the trefoil relative to the kiln shell.

According to another aspect of the present invention, each one of the mating ends includes a pair of opposing mating surfaces, each one of the mating surfaces of each one of the mating ends being even such that each one of the mating surfaces lack interlocking protrusions and recesses. The mating ends may form a wedge shape, whereby each ore of the wedges urges against adjacent ones of the wedges proximate a kiln center to form a pie-shaped hub.

The present invention also includes a method of installing a refractory trefoil in a rotary kiln. The method comprises the steps of: a) preforming at least three legs outside of the rotary kiln of a material comprising a refractory; b) radially positioning a first one the legs at an interior first surface of a rotary kiln; c) radially positioning a second one of the legs at an interior second surface of the rotary kiln that is circumferentially spaced apart from the first surface such that an inner end of the second leg adjoins an inner end of the first leg; d) radially positioning a third one of the legs at an interior third surface of the rotary kiln that is circumferentially spaced apart from the second surface such that an inner end of the third leg adjoins the inner end of each one of the first leg and the second leg, whereby each one of the at least three legs supports at least a portion of the trefoil during rotation of the rotary kiln.

According to another aspect of the method according to the present invention, the method may also include the step of pre-curing or pre-firing the at least three legs prior to step b, step c, and step d. Further, the method may employ installing the channel-like member described above such that each one of the radially positioning steps b, c, and d include inserting a foot of the trefoil leg into the channel-like member.

DESCRIPTION OF A PREFERRED EMBODIMENT

Figure 1:
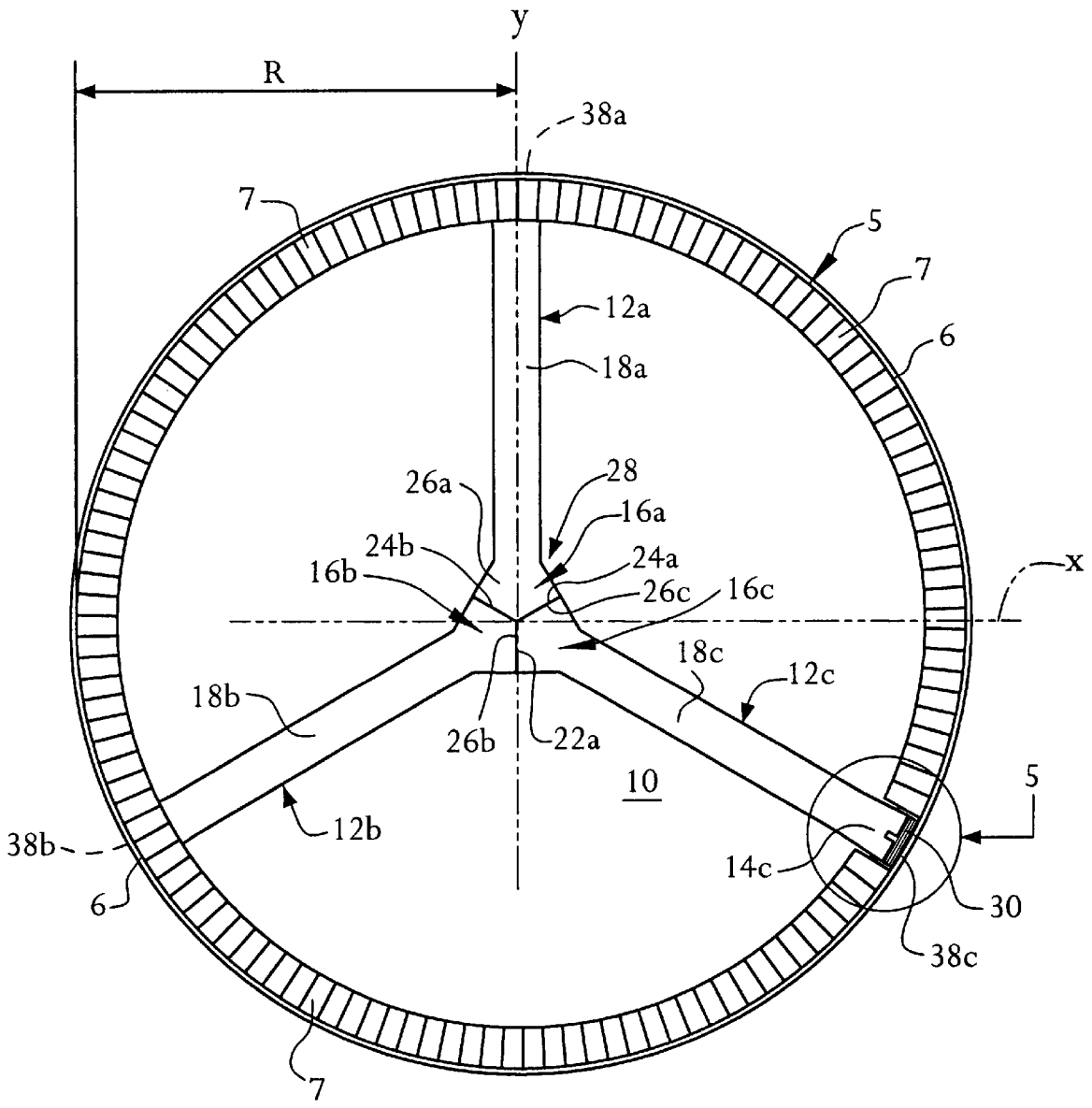
FIG. 1 is an end view of a trefoil according to an embodiment of the present invention installed in a rotary kiln, which is shown in cross section.

Referring to the FIG. 1 to illustrate an embodiment of the present invention, a rotary kiln 5 comprises a long tube that is slightly inclined from the horizontal. Kiln 5 comprises a mild steel, cylindrical shell 6 that has an interior refractory brick lining 7. Each one of the bricks is a conventional rotary kiln block that has non-parallel or tapered sides that enable the assembled bricks to form a circle.

A trefoil heat exchanger 10 according to the present invention comprises three unitary (that is, one-piece), pre-cast, pre-cured legs, designated by reference numerals as 12*a,* 12*b,* and 12*c.* Each of the legs 12*a,* 12*b,* and 12*c* are elongate and oriented radially within a rotary kiln 5 to form substantially triangular spaces therebetween. These spaces form the passages for the solid, granular material to pass counter-current to the gas flow. Numerous trefoils like trefoil 10 may be abutted together to form a trefoil assembly (not shown) longitudinally spanning several feet along the kiln shell 6, as is well known in many industries in which rotary kilns are employed.

Like reference numerals indicate corresponding structure throughout the figures. FIG. 1 employs letter designations "a," "b," and "c" after a base reference numeral to differentiate and identify mutually similar structure or components. Specifically, a structure or component is similar or identical to a corresponding structure or component having the same base number but having a different letter designation in FIG. 1. FIGS. 2 through 5B do not employ the letter designations "a," "b," and "c" that are employed in FIG. 1. The structure or component designated by a base reference numeral without a letter designation in FIGS. 2 through 5B indicates that the structure or component shown may illustrate each of the corresponding structures or component; designated with a letter. For example, FIGS. 2 through 5B indicate the leg as reference numeral 12 to illustrate that the structure may constitute each of the legs 12*a,* 12*b,* and 12*c* shown in FIG. 1. Thus, preferably, legs 12*a,* 12*b,* and 12*c* are substantially identical, although the present invention encompasses employing legs that are not mutually identical.

Referring to FIG. 2 through FIGS. 5A and 5B to describe leg 12, a body 18 extends continuously from a foot 14 to a mating end 16, which is opposite foot 14. Thus, leg 12 is unitary such that it is not formed of individual bricks or blocks. Rather, as shown best in FIGS. 2 through 4, leg 12 is continuously, integrally formed as a single unitary cast member. Preferably, leg 12 is symmetric about the y-z plane FIG. 2. The y-axis lies along a longitudinal centerline line C-LEG. The z-axis lies substantially along the kiln longitudinal centerline (not shown). The x"-axis is substantially tangential to trefoil radius.

Foot 14 is disposed on an end of leg 12 and includes a base surface 15. Foot 14 preferably has a slight outward taper or flare such that the width (that is, in a direction tangent to the circumference of the kiln shell and defined by axis x" in FIG. 2) of base 15 is larger than that of the body 18 of leg 12.

Base surface 15 may have a groove 32 longitudinally formed substantially parallel to the z-axis. Groove 32 may be employed as a key way to receive a key 17, which is shown in phantom in FIG. 2. Key 17 may be affixed to the internal face of kiln shell 6, or to an alignment member, which is described below. Alternatively, key 17 may be omitted. Base 15 may be substantially flat, may be arcuate to correspond to the curvature of the kiln shell 6, or may comprise plural flat, chordal segments (as roughly shown in FIG. 2)

Body 18 preferably has a uniform width (that is, along the x" axis) from the flare of foot 14 to the enlarged portion of mating end 16. The width of body 18 expands in the transition area between body 18 and mating end 16 until leg 12 reaches its maximum width point 19. Mating end 16 forms a substantially wedge shape at the distal portion thereof (that is, inner most tip as defined by the kiln cross section and by the y-axis). Preferably, the wedge shape is a symmetric wedge 22 formed by a pair of opposing, oblique, outward-facing planar mating surfaces: a first surface 24 and a second surface 26 that extend inwardly toward centerline C-LEG from the maximum width point 19. First surface 24 and second surfaced 26 preferably share a common edge that defines the innermost or distal-most tip or edge of leg 12.

Preferably, each of the surfaces 24 and 26 are uniformly even such that they lack interlocking features. Surfaces 24 and 26 preferably lack a tongue-and-groove structure, and similar structure providing a protrusion and a recess, for interlocking the respective parts. Preferably, surfaces 24 and 26 are flat and feature-less and urge against corresponding flat and feature-less surfaces of adjacent legs. The present invention, however, encompasses protrusions and recesses formed in surfaces 24 and 26 such thalt the surfaces interlock (not shown in the Figures) or otherwise more fully engage.

Figure 2:
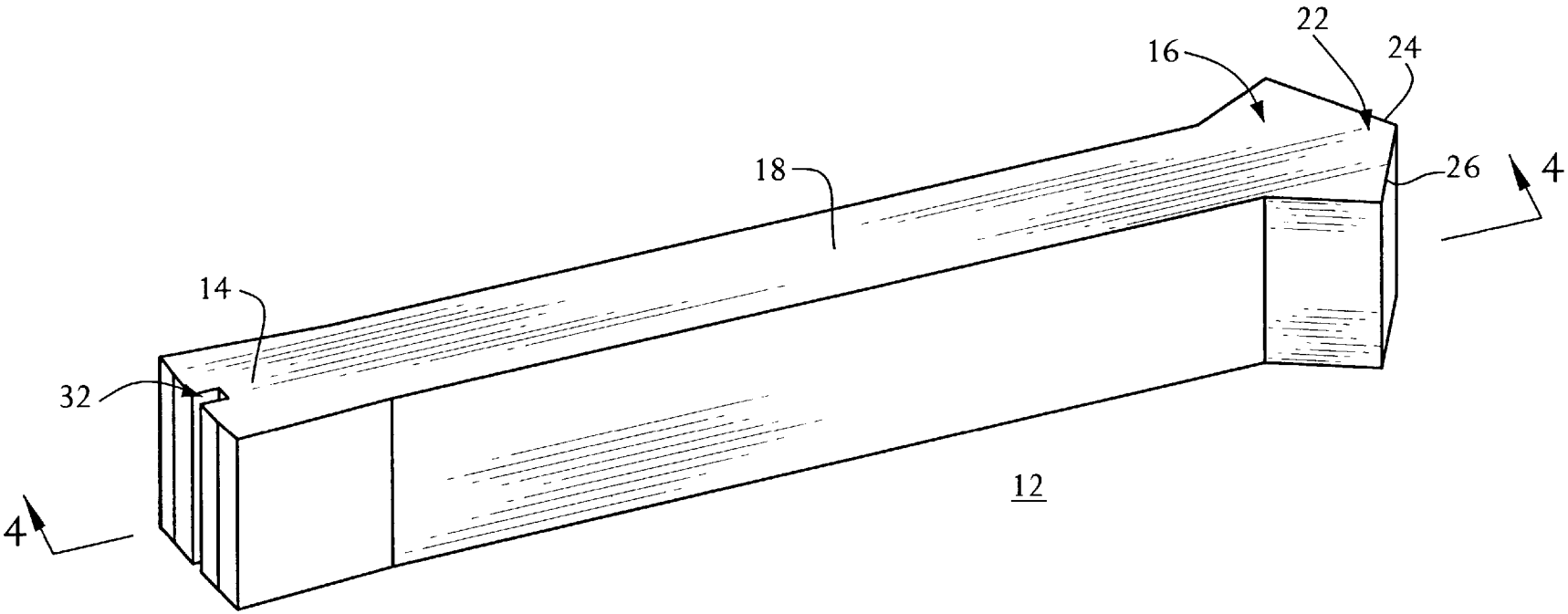
FIG. 2 is a perspective view of a leg that is a component of the embodiment shown in FIG. 1.
Figure 3:
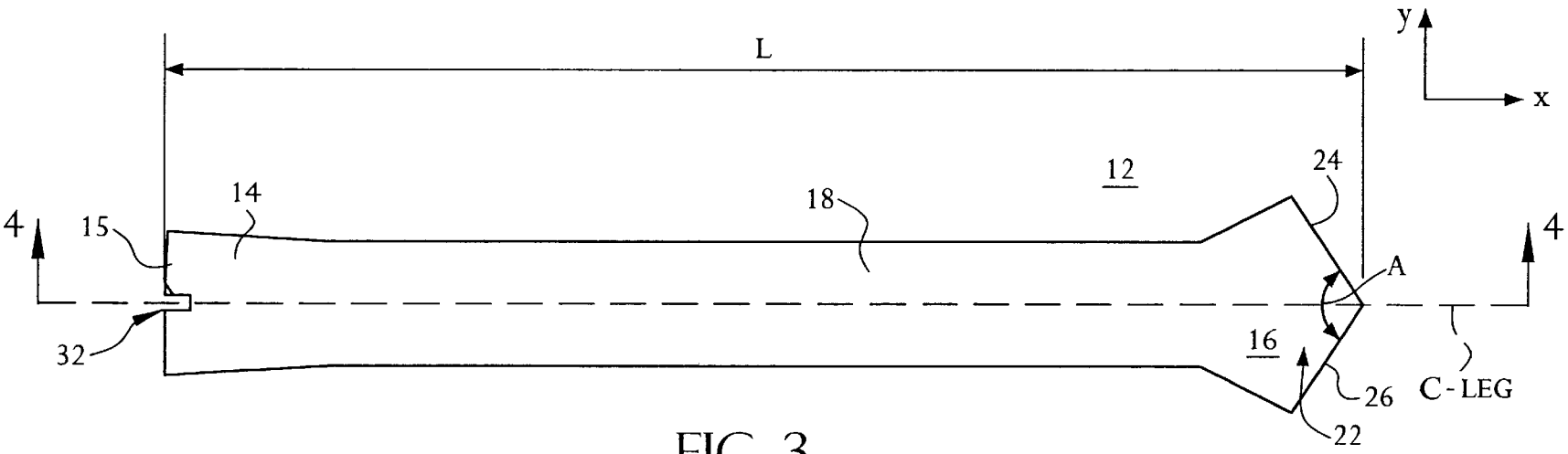
FIG. 3 is a side view of the leg of FIG. 2.
Figure 4:
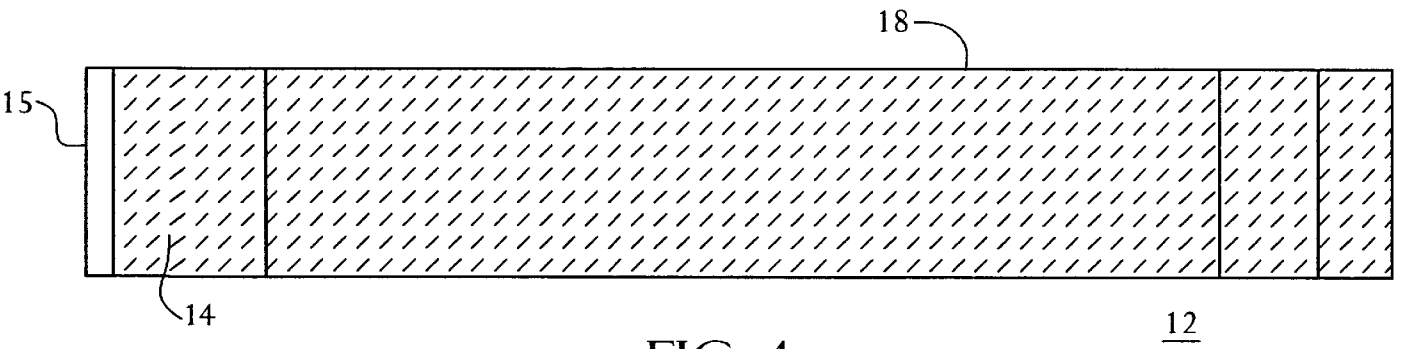
FIG. 4 is a cross section view of the leg taken through lines 4—4 of FIG. 2 and of FIG. 3.

As shown in FIG. 3, surfaces 24 and 26 form an included angle A, which preferably is 120 degrees. Angle A preferably equals 360 degrees divided by the number of legs in the trefoil. For example, for trefoils having four legs (not shown), angle A preferably has a slight outward taper (such taper is preferably radial, that is, along a line perpendicular to the tangent to the kiln circumference) such that the four wedges properly mate together at the trefoil's center. The cross sectional shape of leg 12 taken through the x"-z plane in FIG. 2 preferably is a rectangle regardless of whether the section is taken through foot 14, body 18, or mating end 16. Also, the present invention encompasses any suitable cross sectional shape (for example: integral lifters or dams), which will be apparent to persons familiar with conventional refractory and/or trefoil technology in light of the present disclosure.

Leg 12 is pre-cast and pre-cured of a material suitable for severe, rotary kiln duty. The preferred material should provide the desired thermal volume change, temperature rating, mechanical strength, and resistance to erosion and spalling for the particular application. For example, a particular application in which it is desired for the trefoil 10 to thermally expand to match the thermal expansion of the kiln shell may employ a refractory material that provides minimal shrinkage or slight expansion upon heating to the kiln operating temperature local to the trefoil. This attribute will diminish the chances that the trefoil will fail during the start-up process of the kiln.

The term "pre-cure" as used herein and in the appended claims is not meant to limit the processing temperature prior to the installation. Rather, the term "pre-cure " encompasses curing by freezing, ambient air drying, heating at temperatures up to and above red heat, as those terms are understood by persons familiar with refractory technology. "Pre-curing" drives off free water or volatile components, causes formation of a chemical bond, and/or causes formation of a preliminary ceramic bond or sintering. The particular temperature of pre-curing will depend on the particular material and related variables, as will be understood by persons familiar with refractory technology in light of the present disclosure.

As described above, the legs 12 preferably lack interlocking features. Thus, The trefoil 10 may be formed of a material having a lower mechanical strength rating than the material of a conventional brick or castable trefoil. For example, leg 12 may be formed of low cement, high strength, high alumina castable refractory, such as Hymor 3100 as supplied by Plibrico, (or an equal material from an other manufacturer) for a trefoil disposed near the feed end of a rotary lime kiln that calcines pebble lime. Alternatively, a similar or equal material may be employed that has the combination of temperature rating, abrasion resistance, expansion/contraction characteristics, and structural strength to withstand the particular operating conditions, as will be understood by persons familiar with trefoil technology and/or the particular application, as described more fully below.

Leg 12 preferably has an overall length L, as shown in FIG. 3, that is approximately equal to the internal radius of kiln shell, which is indicated schematically by reference letter R in FIG. 1. More particularly, leg length L is equal to the kiln radius minus an allowance for steel shims and an alignment or positioning member, and an allowance for engagement of the mating ends 16. The steel shims and alignment member, which are employed to position the leg 12, and the engagement of mating ends 16 are described below.

Thus, for a rotary kiln having an internal radius R of 5.75 feet, which yields a kiln internal brick diameter of approximately 10 feet assuming refractory brick 7 that radially is 9 inches thick, leg length L may be approximately 67.25 inches, which provides approximately 1.75 inches for positioning and engagement allowances, and for an assembly tolerance allowance. Such allowances enable installation of the trefoil 10 even in a kiln that has a large ovality (that is, is out-of-round).

Base 15 may have a width (that is, in the x"-direction) of approximately 9.325 inches, body 18 may have a width of approximately 8 inches, and leg 12 may have a thickness or depth D, as shown in FIG. 2 (that is, in the z-direction), of about 6 inches to 18 inches, depending on the particular structural characteristics of the application. Based on typical structural and weight considerations, a leg depth D of about 12 inches is preferred. Each of the mating surfaces-may be approximately 8 inches long from the distal tip (that is, where surface 24 meets surface 26) to point 19.

Thus, leg 12 may be of a size that may be readily transported through the kiln to the desired installation location. For example, a preferred leg 12 as described above may have a weight of approximately 630 pounds, depending on the particular type of refractory material and dimensions employed, which may be transported through the kiln with the same equipment that would be employed to transport brick or castable refractory mix.

Referring particularly to FIG. 1 to illustrate the assembled trefoil 10 according to an aspect of the present invention, a foot 14*a,* 14*b,* or 14*c* is disposed at an end of each one of the legs and adjoins the shell 6 of the rotary kiln. Opposite the feet, each one of the mating ends 16*a,* 16*b,* or 16*c* adjoins other ones of the mating ends. Specifically, mating end 16*a* adjoins mating ends 16*b* and 16*c;* mating end 16*b* adjoins mating ends 16*a* and 16*c;* and mating end 16*c* adjoins mating ends 16*a* and 16*b*. The term "adjoin"—as used in the specification and appending claims to describe the relationship among structures—encompasses the structures being in direct contact (that is, touching) and the structures being in close proximity or near one another without direct contact, such as for example when two structures are separated by a thin member (such as a thermal expansion allowance or steel shim) or a narrow gap. Preferably, mating ends 16*a,* 16*b,* and 16*c* have a thin layer 27*a,* 27*b,* and 27*c* of conventional mortar disposed therebetween as shown in FIG. 1. According to the structure described above, the mating ends 16*a,* 16*b,* and 16*c,* are pie-shaped sections that form a hub 28.

Figure 5A:
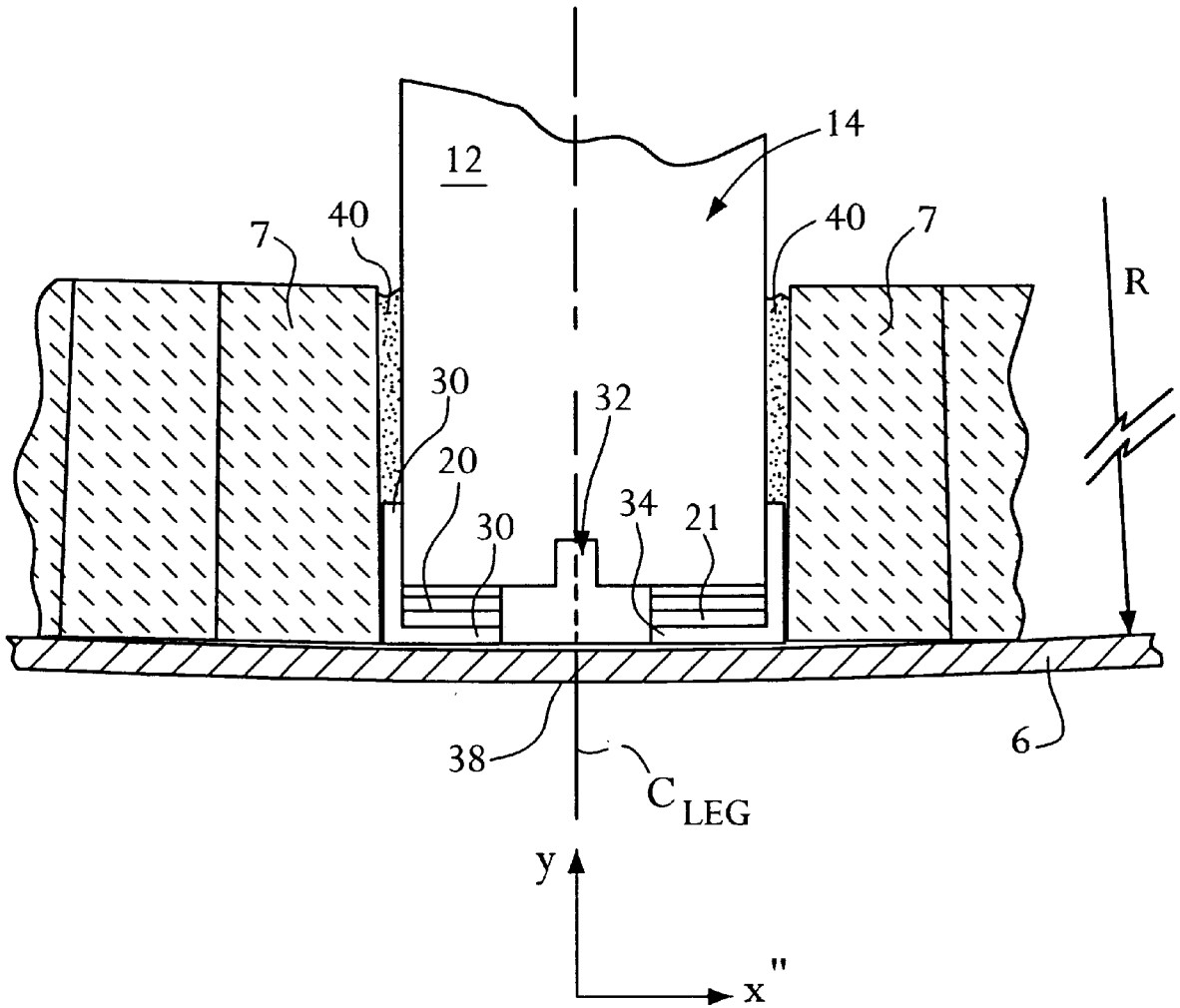
FIG. 5A is an enlarged cross sectional view of an area of FIG. 1 designated as area 5A.

Referring to FIG. 1 and FIG. 5A to illustrate the relationship between foot 14 and kiln shell 6, an alignment or positioning member, such as opposing steel angles 30 and 31, are provided. Steel angles 30 and 31 are preferably welded to the interior surface of kiln shell 6 and span the depth of the foot in the z direction (not shown in FIG. 5A). Shims 20 and 21 may be disposed between the upper surface of the legs of angles 30 and 31, respectively, to position or align leg 12, as described more fully below.

Figure 5B:
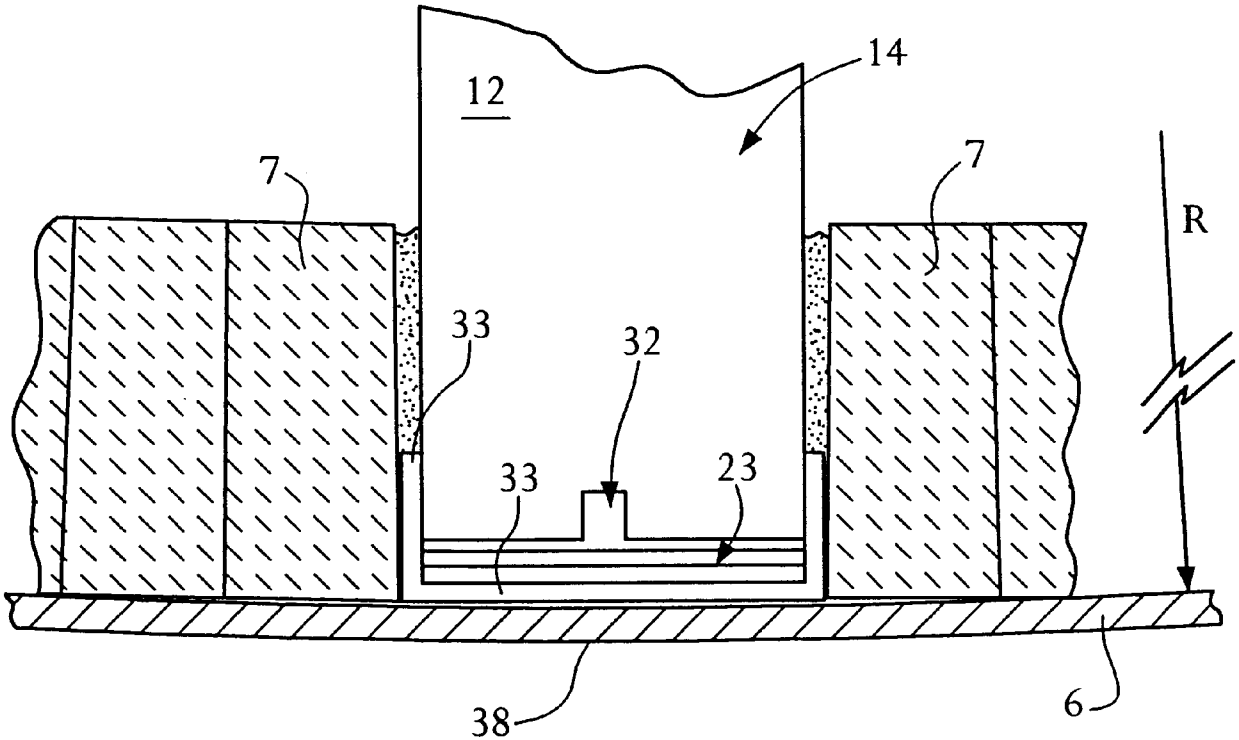
FIG. 5B is a cross sectional view of the area shown in FIG. 5A, showing an, alternate configuration according to an aspect of the present invention.
Figure 6:
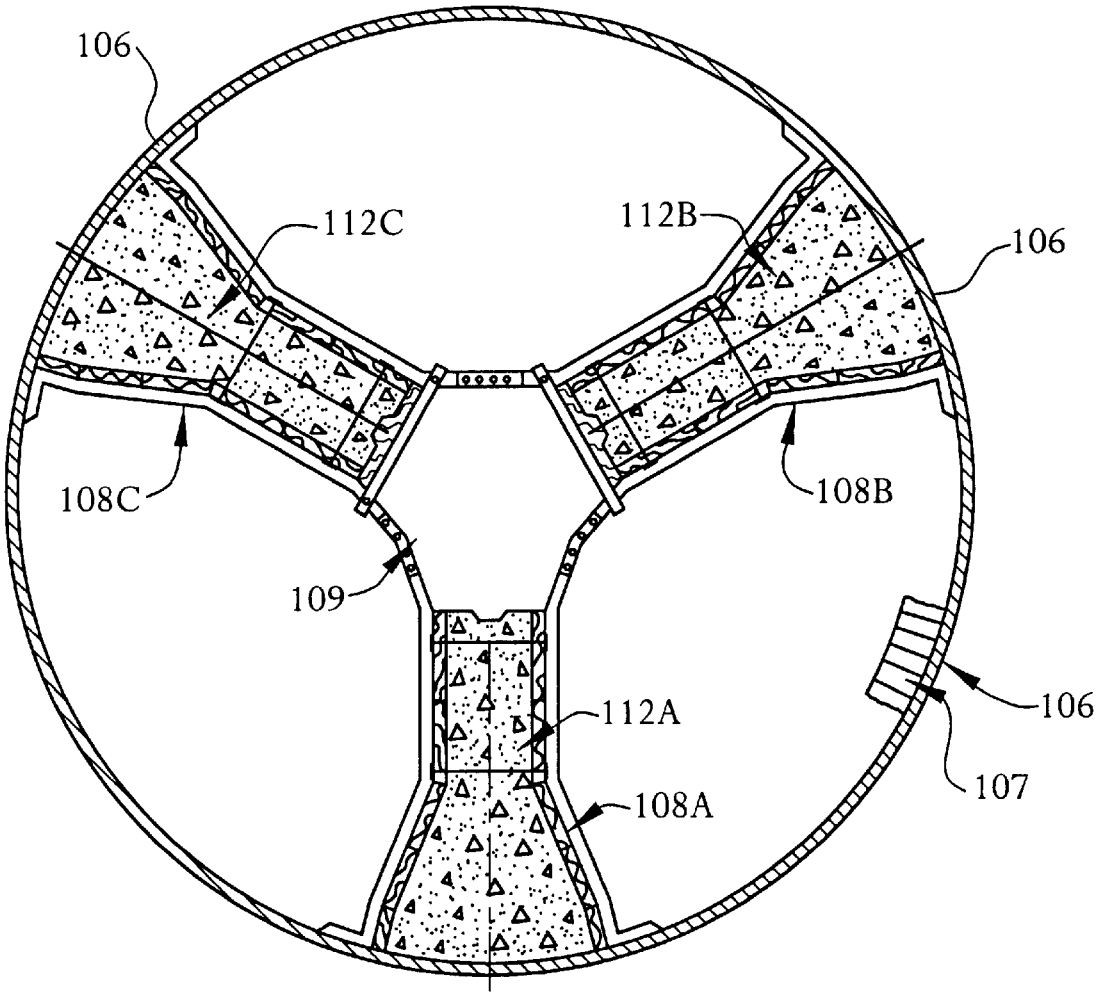
FIG. 6 (PRIOR ART)
FIG. 6 (Prior Art) is a cross sectional view of a conventional cast in-situ trefoil during forming.

Referring to FIG. 5B to illustrate another embodiment of the alignment or positioning member, a channel-like member, preferably a steel channel 33 may be disposed between foot 14 and kiln shell 6. A channel-like member encompasses any structure that provides a pair of opposing members that may support or restrain leg 12. Channel 33 preferably has a width substantially equal to a width of leg 12 and is welded to the interior surface of kiln shell 6, and shims 23 are disposed between the upper base surface of channel 33 and base surface 15 to position or align leg 12.

Figure 7:
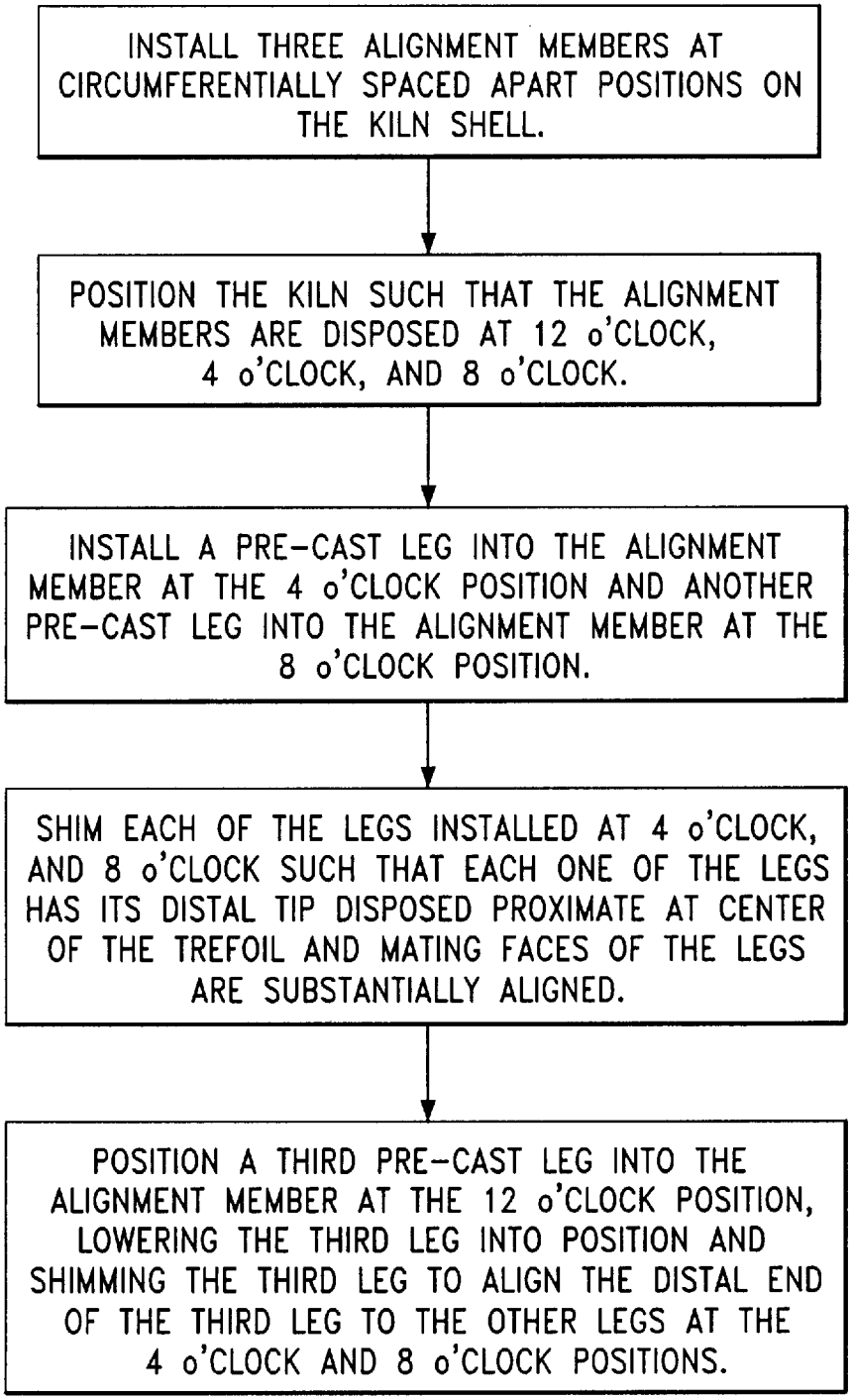
FIG. 7 is a flow diagram of a method according to an aspect of the present invention.

Referring to FIG. 1 and to FIG. 7 to illustrate a method of assembling trefoil 10 according to an aspect of the present invention, legs 12*a,* 12*b,* and 12*c* are preferably manufactured and factory cured (thus, are pre-cast and pre-cured). With the kiln cooled to permit personnel access and the refractory brick lining 7 removed from kiln shell 6 in the area in which trefoil 10 is to be installed, the alignment or positioning member, for example angles 30 and 31, are welded to an interior surface of the kiln shell 6. Angles 30 and 31 are positioned such that their longitudinal axes are aligned parallel to the longitudinal axis of the kiln and the z axis. Angles 30 and 31 are preferably parallel and spaced apart by a distance substantially equal to the width of foot 14 at base 15. Alternatively, channel 33 may be installed.

For a trefoil having three legs, a set of angles 30, 31 should be installed 120 degrees apart, and the kiln should be positioned such that the angles are disposed at 12 o'clock, 4 o'clock, and 8 o'clock positions, as designated by reference numerals 38*a,* 38*b,* and 38*c* in FIG. 1. Optionally, the ovality of the kiln shell may be measured by conventional means to aid in the shimming and alignment process. The kiln may be blocked to prevent further rotation during trefoil installation.

Legs 12*c* and 12*b* may be installed at the 4 o'clock and 8 o'clock positions respectively, and supported by temporary rigging. The mating ends 16*c* and 16*b* of the legs may buttered with a thin layer of conventional mortar. Surfaces 26*b* and 24*c* are aligned such they are mutually parallel and at the appropriate height by shimming between leg base surface 15 and angles 30 and/or 31 corresponding to legs 12*b* and 12*c*. Upon proper shimming, surface 26*b* of leg 12*b* and surface 24*c* of leg 12*c* may be brought into contact, thereby squeezing out excess mortar to form mortar joint 27*a*.

With temporary rigging installed in the kiln, leg 12*a* may be hoisted into the angles 30, 31 at the 12 o'clock position. Surfaces 24*a* and 26*a* may also have a thin layer of mortar applied thereto. Because no shims are yet installed, leg 12*a* has clearance to slide between the angles 30 and 31, and the other legs 12*b* and 12*c*. Leg 12*a* may be fully longitudinally inserted into the angles 30 and 31 at the 12 o'clock position and lowered onto legs 12*b* and 12*c*. Leg 12*a* may be lowered until mating end 16*a* comes into contact with mating ends 16*b* and 16*c*. Shims may be installed between the base surface 15 of leg 12*a* and the angles 30 and 31 at the 12 o'clock position to properly align and wedge leg 12*a* in its desired position, according to the structural and thermal expansion characteristics of the material forming the legs, taking into account the thermal expansion/contraction of the refractory material of the legs 12*a,* 12*b,* and 12*c,* the thermal expansion of the kiln shell 6, and the expected deflection of the shell 6 upon rotation.

Each one of the legs 12*a,* 12*b,* and 12*c* are thereby secured to the kiln shell by the outwardly compressive force transmitted through shims 20 and 21. The term "secure" as used herein and in the appended claims encompasses pressed together without mechanical fasteners, as described immediately above, and fastened by mechanical aids such as fasteners or pins. For example, a key 17 may be welded to the kiln shell 6 or to a channel-like member to insert into groove 32 to restrain movement of each leg 12, thereby securing the leg 12 and the trefoil 10 to the kiln shell 6.

Upon installation, surface 24*a* urges against surface 26*c,* and surface 26*a* urges against surface 24*b,* which squeezes excess mortar therefrom to form mortar joints 27*b* and 27*c,* respectively. Because the mortar preferably is sufficiently thin to enable high points on the respective mating surfaces to contact one another, mating surfaces 24*a* and 26*c* are considered to be in direct mutual contact. Likewise, mating surfaces 24*b* and 26*a,* and 24*c* and 26*b,* are in direct mutual contact.

Thus, mortar joints 27*a,* 27*b,* and 27*c* are preferably formed with only a thin layer of conventional mortar. The present invention encompasses forming thicker mortar joints by other methods; and/or the use of steel shims or compressible thermal expansion spacers, as will be understood by persons familiar with high temperature technology for rotary kilns, thereby preventing direct contact of the respective surfaces 24 and 26, although the respective surfaces 24 and 26 will be adjoining. Further, the present invention encompasses foregoing mortar, thereby installing legs 12*a,* 12*b,* and 12*c* such that surfaces 24*a* and 26*c,* 24*b* and 26*a,* and 24*c* and 26*b* come into direct, dry contact.

After installation of the legs, a conventional mortar 40 may be installed over each of the angles 30 and 31 between the foot 14 and the adjacent kiln bricks 7, as shown in FIG. 5A and FIG. 5B, to protect the angles from the high internal temperature of the rotary kiln 5. The angles 30 and 31 enable the legs 12 to be replaced with removal of a minimum number of kiln bricks 7. For example, upon legs 12 requiring replacement after their normal life, angles 30 and 31 may remain installed and new, replacement legs 12 and shims 20 and 21 may be installed as described above.

Aspects of the present invention are described with reference to a particular embodiment. However, the present invention is not limited to the particular embodiments described herein and includes numerous variations that will be apparent to persons familiar with trefoil and/or refractory technology for rotary kilns in light of the present teachings. For example, the present invention encompasses trefoils having a number of legs greater than three, and includes trefoils that have a more complex structure than a spoke arrangement. Therefore, the appended claims define the appropriate scope of the present invention.

Materials

When heated or cooled, refractory materials may undergo "reversable thermal expansion"—typically abbreviated as TE. When heated above certain critical temperatures, refractory materials may also permanently change size (as a result of internal ceramic reactions), which is called "permanent linear (or volume) change"—typically abbreviated as PLC. TE or a positive PLC (meaning growth) both can exert considerable force on the refractory lining and kiln shell. An important design considerations in rotary kiln linings is balancing the TE with the PLC to maintain this force within acceptable limits, and to maintain a tight lining to reduce shifting, over a wide temperature range. Another important design consideration is to have sufficient hot mechanical strength (that is, at the temperatures of use within the rotary kiln) that structural failure doesn't occur, and that the flow of the product over the refractory surface doesn't abrade the refractory away. Refractory experts will understand that excessive TE, PLC, or hot strength are just as damaging as are insufficient values, and that it is important to obtain a balance of these properties over the range of temperatures to be expected during the first heat up, operation, cool down, and subsequent operational cycles of a rotary kiln.

An example of a suitable material for rotary kilns, where the trefoil of the present invention may encounter temperatures ranging from about 1000–2600 F., would be Plicast Hymor 3100, which is an 80% Alumina class, low cement castable produced by the Plibrico Company. Plicast Hymor 3100 has a negative PLC (that is, shrinkage) up to about 2200 F., which offsets about three-quarters of the TE growth during heating, thereby maintaining a positive tightening force against the kiln shell without overstressing itself or the kiln shell. Above about 2300 F., this material has a positive PLC to help offset long term sintering shrinkage, but also has a reduced hot strength to prevent the positive PLC from exerting undue stresses should the kiln temperature temporarily rise above its normal range, which is common. Those skilled in the art will understand that the absence of joints in our construction, is an advantage for stability, but requires careful selection of refractory expansion and strength properties.

Advantages

The present invention provides, a trefoil device and corresponding installation method that is simpler to manufacture, much quicker and easier to install, lighter (thereby reducing kiln stresses), and constricts air flow less than conventional devices and methods, as well as other advantages that will be apparent to persons familiar with trefoil and/or rotary kiln refractory technology. Further, the trefoil according to the present invention has at least equivalent heat exchange performance, mechanical stability and durability as the current art.

Specifically, for example, employing several one-piece, pre-cast, pre-cured or fired legs to construct each section of the trefoil simplifies manufacturing and installation. Because each leg may vary from 6" to 18" deep (that is, along the kiln longitudinal axis), each leg of the several legs may be in a size/weight range which can be easily transported in the kiln and maneuvered with temporary rigging installed within the kiln shell. Casting and curing or fining the legs outside the rotary kiln (that is, pre-curing) yields reproducible properties and dimensional tolerances comparable to brick, and better than in-situ castable refractory trefoils at a lower cost.

Further, skilled bricklayers are not required for installation, and the modular trefoil requires less installation time (often less than one-half of the installation time), and therefore less kiln down-time than either conventional brick or in-situ cast trefoils. The combination of simplified refractory construction, with simplified and quicker installation, makes the current invention at least one-third less expensive to the rotary kiln operator than most configurations of the current art.

The simple leg design may be formed from a wide range of material compositions and may contain metal fiber reinforcement as required by kiln conditions. In circumstances in which several rows of modular trefoils are abutted together or longitudinally spaced apart, each row may be formed of its own composition according to the kiln conditions at the particular location, without the concern for differing thermal or mechanical material properties that would be needed for traditional trefoils of interlocked bricks or shapes.

The modular trefoil leg tangential or angular thickness may be less than that of brick or in-situ cast trefoils. The thinner legs diminish the constriction to cross sectional area of the rotary kiln, which diminishes pressure drop and dust entrainment through the trefoil. Also, in circumstances in which the desired heat transfer characteristics do not dominate the analysis; because of the mechanical stability of one piece leg, the trefoil length along the longitudinal axis of the kiln may be less than brick construction which diminishes trefoil weight, and therefore kiln stresses, maintenance and operating costs, The installation of pre-fabricated steel alignment members, such as angles or channels, on the kiln shell to align, support, and constrain the base of the precast legs simplifies and speeds installation and repairs. The alignment members prevent trefoil stresses from being transmitted to the brick lining (or vice-versa), and distribute trefoil stresses more evenly to the kiln shell itself. Further, steel shims following established industry practice may be employed to compensate for shell ovality and tighten the three legs to avoid shifting.

What is claimed:

1. A method of installing a refractory trefoil in a rotary kiln comprising the steps of:

a) preforming at least three legs outside of the rotary kiln of a material comprising a refractory;

b) radially positioning a first one the legs at an interior first surface of a rotary kiln;

c) radially positioning a second one of the legs at an interior second surface of the rotary kiln that is circumferentially spaced apart from the first surface such that an inner end of the second leg adjoins an inner end of the first leg;

d) radially positioning a third one of the legs at an interior third surface of the rotary kiln that is circumferentially spaced apart from the second surface such that an inner end of the third leg adjoins the inner end of each one of the first leg and the second leg, whereby each one of the at least three legs supports at least a portion of the trefoil during rotation of the rotary kiln.

2. The method of claim 1 further comprising the step of pre-curing the at least three legs prior to step b, step c, and step d.

3. The method of claim 1 further comprising the step of installing a channel-like member on each one of the kiln first surface, the kiln second surface, and the kiln third surface, each one of the radially positioning steps b, c, and d including inserting a foot of the trefoil leg into the channel-like member.

4. The method of claim 1 further comprising the step of installing shims between the kiln shell and at least one of the legs to adjust the position of the legs and to position each one of the channel like members.

* * * * *